US008881547B2

(12) United States Patent
Ihle

(10) Patent No.: US 8,881,547 B2
(45) Date of Patent: Nov. 11, 2014

(54) HEAT EXCHANGER FOR A REFRIGERATING DEVICE

(75) Inventor: Hans Ihle, Giengen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 1360 days.

(21) Appl. No.: 11/919,917

(22) PCT Filed: Apr. 3, 2006

(86) PCT No.: PCT/EP2006/061270

§ 371 (c)(1),
(2), (4) Date: Nov. 1, 2007

(87) PCT Pub. No.: WO2006/120083

PCT Pub. Date: Nov. 16, 2006

(65) Prior Publication Data

US 2009/0090126 A1 Apr. 9, 2009

(30) Foreign Application Priority Data

May 10, 2005 (DE) ..... 10 2005 021 554

(51) Int. Cl.

| | |
|---|---|
| ***F25B 39/04*** | (2006.01) |
| ***F28D 1/02*** | (2006.01) |
| ***F28D 1/047*** | (2006.01) |
| ***F25D 23/00*** | (2006.01) |

(52) U.S. Cl.

CPC .... *F25D 23/003* (2013.01); *F25D 2323/00276* (2013.01); *F25D 2323/00267* (2013.01); *F28D 1/024* (2013.01); *F28D 1/0472* (2013.01); *F25B 39/04* (2013.01); *F25D 2323/00266* (2013.01); *F25D 2323/0021* (2013.01); *F25D 2323/00277* (2013.01)

USPC ..... 62/507

(58) Field of Classification Search

USPC ..... 62/428, 429, 507, 454, 455; 165/125, 165/177, 126, 163

See application file for complete search history.

(56) References Cited

U.S. PATENT DOCUMENTS

| | | | | |
|---|---|---|---|---|
| 2,115,288 | A | 4/1938 | Smith | |
| 2,187,066 | A | 1/1940 | Youker | |
| 2,311,947 | A | 2/1943 | Kucher | |
| 4,321,803 | A * | 3/1982 | Smith | 62/507 |
| 4,335,782 | A * | 6/1982 | Parker | 165/166 |
| 4,592,888 | A | 6/1986 | Cornu et al. | |
| 4,953,364 | A * | 9/1990 | Lee | 62/285 |
| 5,592,829 | A | 1/1997 | Kim | |
| 7,121,328 | B1 * | 10/2006 | McDonald et al. | 165/125 |

FOREIGN PATENT DOCUMENTS

| | | |
|---|---|---|
| GB | 2 085 143 | 4/1982 |

OTHER PUBLICATIONS

International Search Report PCT/EP2006/061270.

* cited by examiner

*Primary Examiner* — Melvin Jones
(74) *Attorney, Agent, or Firm* — Nixon & Vanderhye, P.C.

(57) ABSTRACT

The invention relates to a housing that houses a coiled conduit for a first heat transfer fluid with the housing open at two front sides and surrounding the coil. A wall of the housing that extends in the longitudinal direction of the coil is provided with passages.

19 Claims, 2 Drawing Sheets

HEAT EXCHANGER FOR A REFRIGERATING DEVICE

This application is a U.S. National Phase of International Application No. PCT/EP2006/061270, filed Apr. 3, 2006, which designates the U.S. and claims priority to German Application No. 102005021554.8, filed May 10, 2005, the entire contents of each are hereby incorporated by reference.

BACKGROUND OF THE INVENTION

The present invention relates to a heat exchanger having an open, tube-like housing and a conduit arranged therein that serves to duct a first heat-transfer fluid and which has an uncoiled length exceeding the length of the housing, which is open at both its front sides to allow a second heat-transfer fluid to flow through it, and to a refrigerating device in which a heat exchanger of said type is employed. A heat exchanger and refrigerating device of said type are known from U.S. Pat. No. 5,592,829.

In said known heat exchanger the conduit is embodied as a coil. The housing surrounding the coil forces the flow of the second heat-transfer fluid so it sweeps along the coil's entire length in order thus to achieve a high heat-exchange efficiency at a moderate throughput rate for the second heat-transfer fluid.

That, though, gives rise to the problem that, with the flow through the heat exchanger being substantially parallel to the coil's longitudinal axis, a considerable portion of the second heat-transfer fluid will pass through the heat exchanger without at all attaining close proximity to the conduit, while other parts of the flow will successively sweep along many turns in the coil and substantially heat up while doing so.

SUMMARY OF THE INVENTION

An object of the present invention is to improve the efficiency of a heat exchanger of the kind cited in the introduction.

That is inventively achieved by providing sections of the housing's surface area with passages at least in the region of a first front side.

Said passages will, depending on pressure conditions prevailing in the housing, allow second heat-exchange fluid to flow in or out. Its flow field within the housing will thus not be oriented purely in the longitudinal direction but will also have radial components so that conduit sections situated at a distance from the housing's open front sides such as, for instance, the turns in a coil or longitudinal sections of a conduit that is meander-shaped or arranged in at least one loop can also be flowed against by second heat-transfer fluid not yet heated (or, depending on the direction of the heat flow in the heat exchanger, not yet cooled) at another section of the coil or meander.

A favorable application all around the conduit within the housing of air not yet heated by other conduit sections will result if the passages having an opening cross-section that is either the same or different are advantageously disposed evenly distributed around the surface area's circumference. The passages' portion of the wall's surface will preferably reduce with increasing distance from a first front side of the housing. The streaming conditions and hence the transfer of heat from the conduit to a second heat-transfer fluid will be particularly favorable if, according to a preferred embodiment, the opening cross-section of the passages reduces with increasing distance from the first front side. One half of the housing adjacent to the second front side can be free from passages.

The heat exchanger is preferably provided with a fan for driving the second heat-transfer fluid's flow through the housing.

Said fan is located preferably on the second front side of the housing.

Referred to the second heat-transfer fluid's flow direction, said second front side is preferably a downstream side, meaning that the fan will suck the second heat-transfer fluid through the housing and the second refrigerant will flow entirely through the opening on the second front side so it can be taken from there and ducted to a further application.

The fan can alternatively also be located centrally in the housing, in which case it can be provided for a portion of the wall's surface occupied by the passages to reduce from both front sides of the housing towards the fan so that second heat-transfer fluid can enter the housing through the passages located upstream of the fan and exit the housing through the passages located downstream of the fan.

A further subject of the invention is a refrigerating device having a heat exchanger of the aforementioned type as a condenser. The second heat-transfer fluid is in that case generally air, whereas the first heat-transfer fluid is a refrigerant of the refrigerating device.

BRIEF DESCRIPTION OF THE DRAWINGS

Further features and advantages of the invention will emerge from the following description of exemplary embodiments with reference to the attached figures.

DETAILED DESCRIPTION OF THE EXEMPLARY EMBODIMENTS OF THE PRESENT INVENTION

Figure 1:
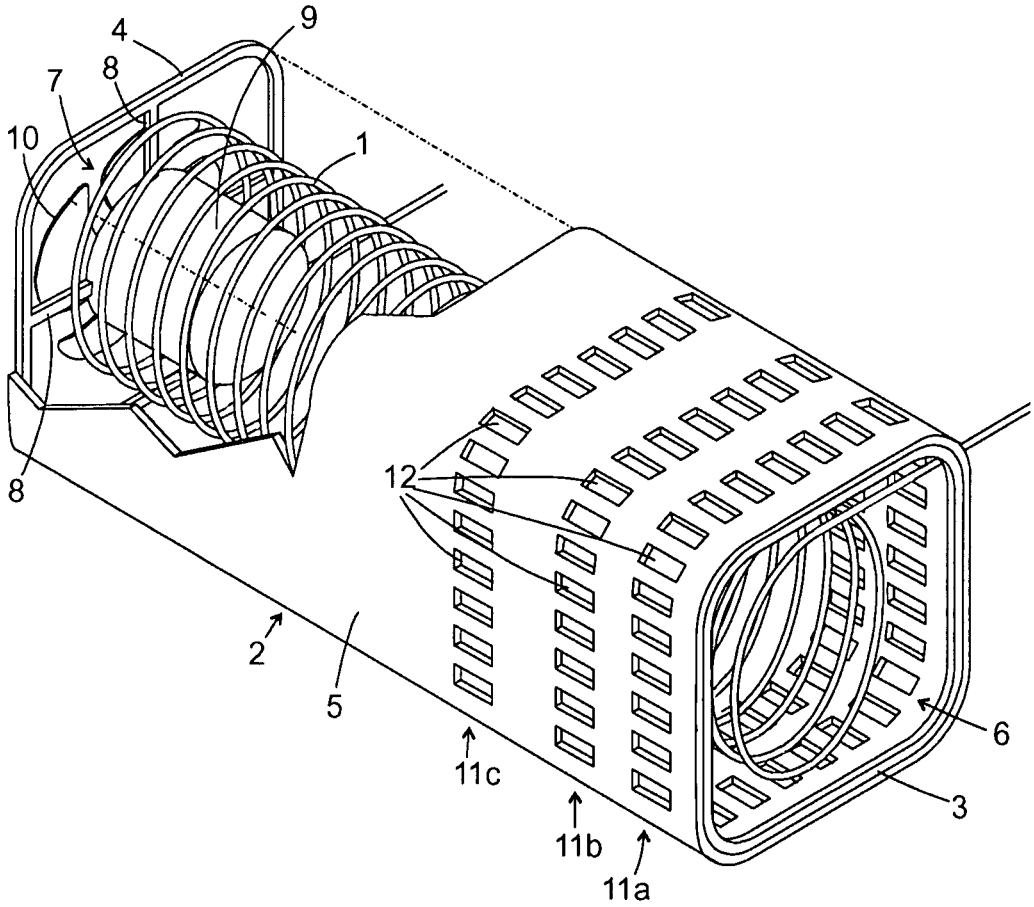
FIG. 1 is a perspective view of an inventive heat exchanger.

The heat exchanger shown in FIG. 1 includes a tubular conduit 1 bent into a helical coil for a first heat-transfer fluid, preferably a refrigerant. A housing 2 extends coaxially relative to the longitudinal axis A of the tubular conduit 1. The housing 2 is here constructed essentially from two rigid chassis elements 3, 4 forming opposite front sides of the housing 2 and from a metal sheet 5 extending around the outer edges of the two chassis elements 3, 4 and forming four side walls of the housing. The chassis element 3 facing the observer has a large-area inner opening 6; radial braces 8 that support an electric motor 9 coaxially relative to the coiled tubular conduit 1 engage with a corresponding opening 7 in the other chassis element 4. The electric motor 9 drives a fan wheel 10 projecting from the housing 2, thereby causing air to flow through the housing 2 from the side of the chassis element 3 to that of the chassis element 4.

Three groups 11*a*, 11*b*, 11*c* of passages 12 have been punched into the metal sheet 5. The distance between adjacent groups of passages increases with increasing distance from the opening 6 so that the passages 12 will occupy a reducing portion of the surface of the metal sheet 5 with increasing distance from the opening 6. There are no passages 12 on the half of the metal sheet 5 adjacent to the opening 7.

Figure 2:
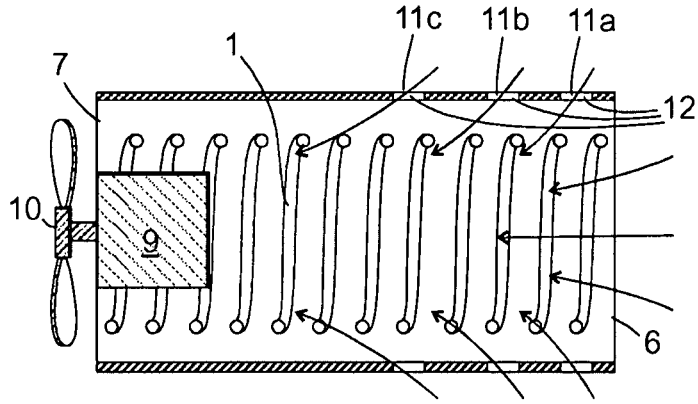
FIG. 2 is a longitudinal section through the heat exchanger shown in FIG. 1, which section illustrates the flow conditions inside the heat exchanger.

FIG. 2 illustrates the flow conditions inside the inventive heat exchanger with the aid of an axial sectional view. A large part of the air conveyed by the fan wheel 10 through the heat exchanger enters it through the opening 6. Were that the only air-intake opening, the result would be an air stream that is substantially parallel to the longitudinal axis and in the case of which a part of the air flows alongside the tubular conduit 1 while a large part of the air stream passes through the coil's open interior and absorbs as good as no heat from the tubular conduit 1 while doing so. Moreover, the turns in the tubular conduit 1 that are in such a case situated one behind the other in the flow direction will brake the air stream hard so that a high flow speed, which accounts for a substantial part of the heat exchanger's air throughput rate, will be attained in the coil's empty interior. The passages 12, on the other hand, will allow an influx of air from a lateral direction that continues inside the housing 2 transversally to the longitudinal axis so that turns in the tubular conduit 1 that are situated far from the intake opening 6 will also still be reached by cool fresh air.

The fan's operation produces a pressure gradient within the housing 2, meaning that the difference in pressure between the housing's interior and ambient area will increase along the housing's longitudinal axis the closer the fan is approached. The greater the difference in pressure is between the interior and exterior, the greater also will be the air throughput rate per unit of area of each passage 12. To insure that the turns are supplied with cool fresh air as evenly as possible, the passages 12 must therefore, as already mentioned above, occupy an increasingly smaller portion of the surface of the metal sheet 5 with increasing distance from the opening 6. Instead of increasing the distance between the groups 11*a*, 11*b*, 11*c* with increasing distance from the opening 6, as shown in FIGS. 1 and 2, that could of course also be achieved by making the area of the individual passages 12 smaller the further they are from the opening 6.

Figure 3:
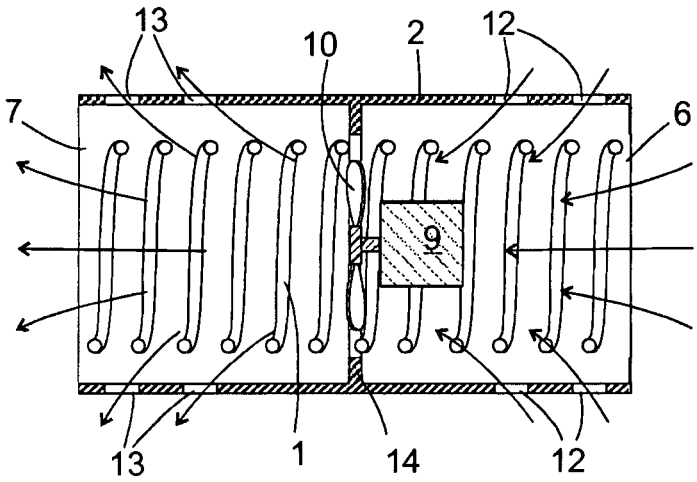
FIG. 3 is a longitudinal section through a second embodiment of the heat exchanger.

A variant embodiment of an inventive heat exchanger is shown in FIG. 3 in a section analogous to that shown in FIG. 2. The fan formed by the electric motor 9 and the fan wheel 10 is in that embodiment located centrally in the heat exchanger, within the coil formed by the tubular conduit 1. Formed adjacently to the upstream opening 6 of the housing 2 are, here also, two groups of passages 12 and, as mirror images thereof, further passages 13 are located in a region, adjacent to the downstream opening 7, of the metal sheet 5. Said passages 13 will give the air flow downstream of the fan a radially outwardly oriented speed component so that a turn in the tubular conduit 1 will here, too, be prevented from being in an adjacent turn's wind shadow and not being supplied sufficiently with cooling air.

To prevent air inside the housing 2 from flowing back from the downstream to the upstream side of the fan within the cross-sectional area lying outside the coil, a partition 14 is provided here that extends from the metal sheet 5 forming the external wall of the housing 2 at the height of the fan wheel 10 to the immediate vicinity of the coil.

Figure 4:
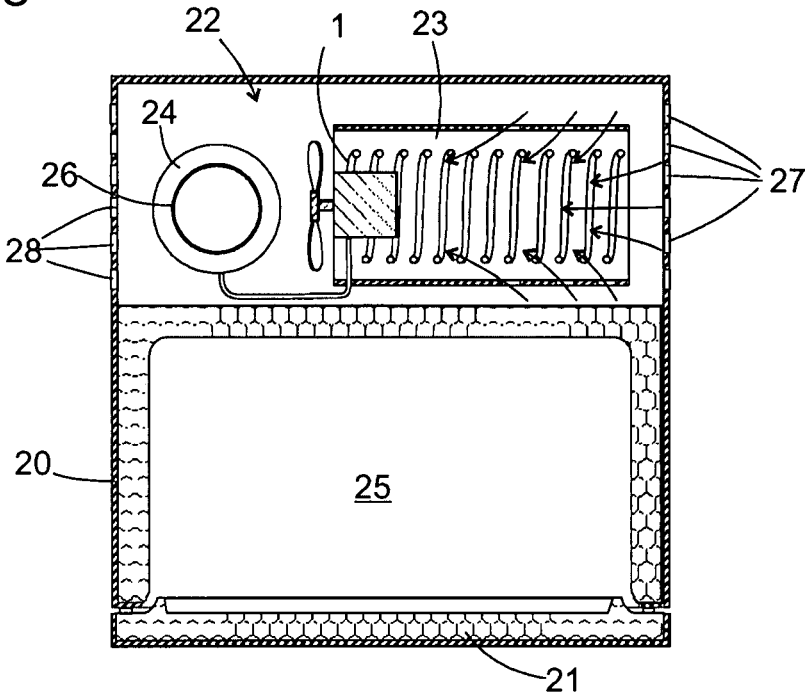
FIG. 4 is a schematic horizontal section through the pedestal area of a refrigerating device in which an inventive heat exchanger has been installed.

FIG. 4 shows as an exemplary application of the inventive heat exchanger a horizontal section through a refrigerator or freezer having a carcass 20 and a door 21. In a region of the carcass 20 near the floor, on the side facing away from the door 21, a machine space 22 has been left open in which next to each other are housed the heat exchanger, shown in FIG. 1 or, as the case may be, FIG. 2 as the condenser 23 for a refrigerant and a condenser 24. The tubular conduit 1 of the condenser 23 is connected to a high-pressure outlet of the condenser 24. A refrigerant and fresh air driven by the fan pass through the condenser 23 in opposite directions. Fresh air heated in the condenser 23 flows towards the condenser 24 and cools it; said air also promotes the evaporation in an evaporating dish 26, mounted on the condenser 24, of condensation water ducted from the refrigerating device's interior 25. Air intake and outlet openings 27 or, as the case may be, 28 have here been formed in side walls of the machine space 22; they could alternatively have been provided in its base in order to supply and remove fresh air through a hollow device pedestal located beneath the carcass 20, or the rear of the machine space 22 could have been left open in parts to allow an exchange of air.

The invention claimed is:

1. A heat exchanger comprising:

a housing having an overall tubular configuration, the housing having an exterior sheet metal wall and one end that is open and an opposite end that is open, a conduit having an uncoiled length exceeding the length of the housing, a first heat-transfer fluid being conducted through the conduit, the housing being operable to receive the conduit therewithin, the housing being operable to guide therethrough a second heat transfer fluid such that a heat exchange operation takes place between the second heat transfer fluid guided through the housing and the conduit having therein the first heat transfer fluid while the first heat transfer fluid advances along the conduit in a direction from the one end of the housing toward the opposite end of the housing, and the housing having surface area portions forming passages through which the second heat transfer fluid can enter the housing, the surface area portions of the housing being located in a region more proximate to the one end of the housing than the opposite end of the housing, wherein all passages in the sheet metal wall adapted to allow the second heat transfer fluid to enter the housing, except for the opposite end that is open, are closer to the one end than the opposite end.

2. The heat exchanger as claimed in claim 1, wherein the passages are evenly distributed over a circumference of the surface area of the housing.

3. A heat exchanger comprising:

a housing having an overall tubular configuration, the housing having an exterior sheet metal wall and one end that is open and an opposite end that is open, the housing being operable to receive therewithin a conduit having an uncoiled length exceeding a length of the housing, a first heat-transfer fluid being conducted through the conduit, the housing being operable to guide therethrough a second heat transfer fluid such that a heat exchange operation takes place between the second heat transfer fluid guided through the housing, the conduit having therein the first heat transfer fluid while the first heat transfer fluid advances along the conduit in a direction from the one end of the housing toward the opposite end of the housing, the housing having surface area portions forming passages through which the second heat transfer fluid can enter the housing, these surface area portions of the housing being located in a region more proximate to the one end of the housing than the opposite end of the housing, and the portion of the surface area of the housing occupied by the passages reduces with increasing distance from the one end of the housing.

4. A heat exchanger comprising:

a housing having an overall tubular configuration, the housing having an exterior sheet metal wall and one end that is open and an opposite end that is open, the housing being operable t receive therewithin a conduit having an uncoiled length exceeding a length of the housing, a first heat-transfer fluid being conducted through the conduit, the housing being operable to guide therethrough a second heat transfer fluid such that a heat exchange operation takes place between the second heat transfer fluid guided through the housing, the conduit having therein the first heat transfer fluid while the first hear transfer fluid advances along the conduit in a direction from the one end of the housing toward the opposite end of the housing, the housing having surface area portions forming passages through which the second heat transfer fluid can enter the housing, these surface area portions of the housing being located in a region more proximate to the one end of the housing than the opposite end of the housing, and the opening cross-section of the passages reduces with increasing distance from the one end of the housing.

5. A heat exchanger comprising:

a housing having an overall tubular configuration, the housing having an exterior sheet metal wall and one end that is open and an opposite end that is open, the housing being operable to receive therewithin a conduit having an uncoiled length exceeding a length of the housing, a first heat-transfer fluid being conducted through the conduit, the housing being operable to guide therethrough a second heat transfer fluid such that a heat exchange operation takes place between the second heat transfer fluid guided through the housing, the conduit having therein the first heat transfer fluid while the first heat transfer fluid advances along the conduit in a direction from the one end of the housing toward the opposite end of the housing, the housing having surface area portions forming passages through which the second heat transfer fluid can enter the housing, these surface area portions of the housing being located in a region more proximate to the one end of the housing than the opposite end of the housing, and a respective half of the housing that forms the opposite end of the housing is free of passages.

6. The heat exchanger as claimed in claim 1, wherein the housing is operable to accommodate therein the conduit that is coil shaped and that has a coil length at least approximately the length of the housing.

7. The heat exchanger as claimed in claim 1, wherein the housing is operable to accommodate therein the conduit that is meander shaped with the length of the meander-shaped portion of the conduit corresponding approximately to the length of the housing.

8. The heat exchanger as claimed in claim 1 and further comprising a fan for driving a flow of a second heat-transfer fluid through the housing.

9. The heat exchanger as claimed in claim 8, wherein the fan is located at the opposite end of the housing.

10. The heat exchanger as claimed in claim 1, wherein the opposite end of the housing is downstream as viewed in the flow direction of the second heat-transfer fluid through the housing.

11. The heat exchanger as claimed in claim 8, wherein the fan is located centrally in the housing.

12. A heat exchanger comprising:

a housing having an overall tubular configuration, the housing having an exterior sheet metal wall and one end that is open and an opposite end that is open, the housing being operable to receive therewithin a conduit having an uncoiled length exceeding a length of the housing, a first heat-transfer fluid being conducted through the conduit, the housing being operable to guide therethrough a second heat transfer fluid such that a heat exchange operation takes place between the second heat transfer fluid guided through the housing, the conduit having therein the first heat transfer fluid while the first heat transfer fluid advances along the conduit in a direction from the one end of the housing toward the opposite end of the housing, the housing having surface area portions forming passages through which the second heat transfer fluid can enter the housing, these surface area portions of the housing being located in a region more proximate to the one end of the housing than the opposite end of the housing, and a fan for driving a flow of a second heat-transfer fluid through the housing, the fan the located centrally in the housing, wherein passages are formed on the respective half of the housing that forms the opposite end of the housing, and passages are formed on the respective half of the housing that forms the one end of the housing, and the portion of the surface area of the housing on which the passages are formed reduces from the opposite end of the housing towards the fan and from the one end of the housing towards the fan.

13. A refrigerating device comprising:

a.) a compartment for keeping items cool; and b.) a heat exchanger operable as a condenser in a cooling loop that supplies cooled fluid relative to the compartment, the heat exchanger comprising:

a housing having an overall tubular configuration, the housing having an exterior sheet metal wall and one end that is open and an opposite end that is open, a conduit having an uncoiled length exceeding an entire length of the housing, a first heat-transfer fluid being conducted through the conduit, the housing being operable to receive the conduit therewithin, the housing being operable to guide therethrough a second heat transfer fluid such that a heat exchange operation takes place between the second heat transfer fluid guided through the housing and the conduit having therein the first heat transfer fluid while the first heat transfer fluid advances along the conduit in a direction from the one end of the housing toward the opposite end of the housing, and the housing having surface area portions forming passages through which a second heat transfer fluid can enter the housing, the surface area portions of the housing being located in a region more proximate to the one end of the housing than the opposite end of the housing, wherein all passages adapted to allow the second heat transfer fluid to enter the housing, except for the opposite end that is open, are closet to the one end than the opposite end.

14. The heat exchanger as claimed in claim 8, wherein the fan is located centrally in the housing between the one end of the housing and the opposite end of the housing along the flow direction of the second heat-transfer fluid through the housing.

15. The heat exchanger as claimed in claim 14, wherein the conduit forms a coil within the housing, and wherein the fan is located within the coil formed by the conduit.

16. A heat exchanger comprising:

a housing having an overall tubular configuration, the housing having an exterior sheet metal wall and one end that is open and an opposite end that is open, the housing being operable to receive therewithin a conduit having an uncoiled length exceeding a length of the housing, a first heat-transfer fluid being conducted through the conduit, the housing being operable to guide therethrough a second heat transfer fluid such that a heat exchange operation takes place between the second heat transfer fluid guided through the housing, the conduit having therein the first heat transfer fluid while the first heat transfer fluid advances along the conduit in a direction from the one end of the housing toward the opposite end of the housing, the housing having surface area portions forming passages through which the second heat transfer fluid can enter the housing, these surface area portion of the housing being located in a region more proximate to the one end of the housing than the opposite end of the housing, a fan for driving a flow of a second heat-transfer fluid through the housing, the fan is located centrally in the housing between the one end of the housing and the opposite end of the housing along the flow direction of the second heat-transfer fluid through the housing, and the conduit forms a coil within the housing, wherein the fan is located within the coil formed by the conduit a partition located centrally in the housing at the location of the fan and within a cross-sectional area lying outside the coil, the partition extending from an interior surface of the housing towards the coil and extending such that a surface nearest the coil is closer to the coil than the interior surface of the housing.

17. A heat exchanger comprising:

a tubular housing having an exterior sheet metal wall, the tubular housing having one end that is open and an opposite end that is open;

a coiled conduit in a hollow interior of the tubular housing, the coiled conduit having an uncoiled length that is greater than the length of the tubular housing in a longitudinal direction from the one end to the opposite end; and a first heat-transfer fluid being conducted through the coiled conduit;

the tubular housing being operable to guide a second heat-transfer fluid therethrough such that a heat exchange operation takes place between the second heat transfer fluid being guided through the tubular housing and the coiled conduit having therein the first heat transfer fluid while the first heat transfer fluid advances along the coiled conduit in a direction from the one end of the tubular housing toward the opposite end of the tubular housing, wherein the exterior sheet metal wall includes a plurality of passages through which the second heat transfer fluid can enter the interior of the tubular housing, the plurality of passages being located in a region of the exterior sheet metal wall that is nearer the one end of the tubular housing than the opposite end of the tubular housing, and wherein all passages in the sheet metal wall adapted to allow the second heat transfer fluid to enter the housing, except for the opposite end that is open, are closer to the one end than the opposite end.

18. The heat exchanger as claimed in claim 17, wherein the coiled conduit extends the length of the tubular housing.

19. A heat exchanger comprising:

a tubular housing having an exterior sheet metal wall, the tubular housing having one end that is open and an opposite end that is open;

a coiled conduit in a hollow interior of the tubular housing, the coiled conduit having an uncoiled length that is greater than a length of the tubular housing in a longitudinal direction from the one end to the opposite end; and a first heat-transfer fluid being conducted through the coiled conduit;

the tubular housing being operable to guide a second heat-transfer fluid therethrough such that a heat exchange operation takes place between the second heat transfer fluid being guided through the tubular housing and the coiled conduit having therein the first heat transfer fluid while the first heat transfer fluid advances along the coiled conduit in a direction from the one end of the tubular housing toward the opposite end of the tubular housing, wherein the exterior sheet metal wall includes a plurality of passages through which the second heat transfer fluid can enter the interior of the tubular housing, the plurality of passages being located in a region of the exterior sheet metal wall that is nearer the one end of the tubular housing than the opposite end of the tubular housing, wherein the coiled conduit extends the length of the tubular housing, and wherein the coiled conduit extends into the interior of the tubular housing in the region of the exterior sheet metal wall that is nearer the one end of the tubular housing than the opposite end of the tubular housing.

* * * * *

UNITED STATES PATENT AND TRADEMARK OFFICE

CERTIFICATE OF CORRECTION

PATENT NO. : 8,881,547 B2
APPLICATION NO. : 11/919917
DATED : November 11, 2014
INVENTOR(S) : Hans Ihle It is certified that error appears in the above-identified patent and that said Letters Patent is hereby corrected as shown below:

In the Claims

Column 5, line 5, "the housing being operable t receive therewithin a conduit" should read "the housing being operable to receive therewithin a conduit."

Column 5, line 16, "the first hear transfer fluid advances along the conduit in" should read "the first heat transfer fluid advances along the conduit in."

Column 6, line 64, "site end that is open, are closet to the one end than the" should read "site end that is open, are closer to the one end than the."

Column 7, line 25, "the housing having surface area portions forming passages" should read "the housing having surface area portion forming passages."

Signed and Sealed this
Seventh Day of April, 2015

Michelle K. Lee

Michelle K. Lee
*Director of the United States Patent and Trademark Office*